United States Patent [19]

Beshany

[11] 4,031,662

[45] June 28, 1977

[54] MONORAIL TRAIN AND TRACK

[76] Inventor: Alan S. Beshany, P.O. Box 15065, Plantation, Fla. 33318

[22] Filed: July 21, 1976

[21] Appl. No.: 707,272

[52] U.S. Cl. ..... 46/257; 104/89; 104/148 MS

[51] Int. Cl.[2] ..... A63H 19/10; A63H 21/04

[58] Field of Search ..... 46/216, 257, 259, 260; 104/89, 118, 119, 147, 148 LM, 148 MS; 238/148, 150

[56] References Cited

UNITED STATES PATENTS

| | | | |
|---|---|---|---|
| 3,457,876 | 7/1969 | Holden | 104/89 |
| 3,500,580 | 3/1970 | Munzing | 46/257 |
| 3,570,177 | 3/1971 | Tomaro | 46/260 |
| 3,610,162 | 10/1971 | Lawrence | 104/118 |

FOREIGN PATENTS OR APPLICATIONS

| | | | |
|---|---|---|---|
| 662,327 | 4/1963 | Canada | 46/217 |

*Primary Examiner*—Louis G. Mancene
*Assistant Examiner*—Robert F. Cutting
*Attorney, Agent, or Firm*—Oltman and Flynn

[57] ABSTRACT

An improved monorail track and wheel arrangement is provided for a monorail train, specifically a model monorail train. The monorail train includes an engine having an electric motor, conductive wheels, a drive train for driving the wheels, electrical connections between the motor and the wheels for supplying current to the motor and a track for conducting current. In accordance with the improvement of the invention, the wheels have rims with vertical flanges on the outside thereof, and are arranged in pairs to straddle the track. The flanges are positioned on the outsides of the track when the engine is on the track. The track comprises monorail means for receiving the wheels, and the monorail means has an insulating upper surface and two L-shaped conductor means forming outside corners for the upper surface for engaging both the rims and the flanges of the wheels. Each of the L-shaped conductor means has a horizontal leg for engaging the rims of corresponding wheels and a vertical leg for engaging the flanges of corresponding wheels. Thus, there is excellent electrical contact between the wheels and the L-shaped conductors both at the rim and the flanges, and the flanges retain the train on the track laterally.

10 Claims, 6 Drawing Figures

FIG. 1
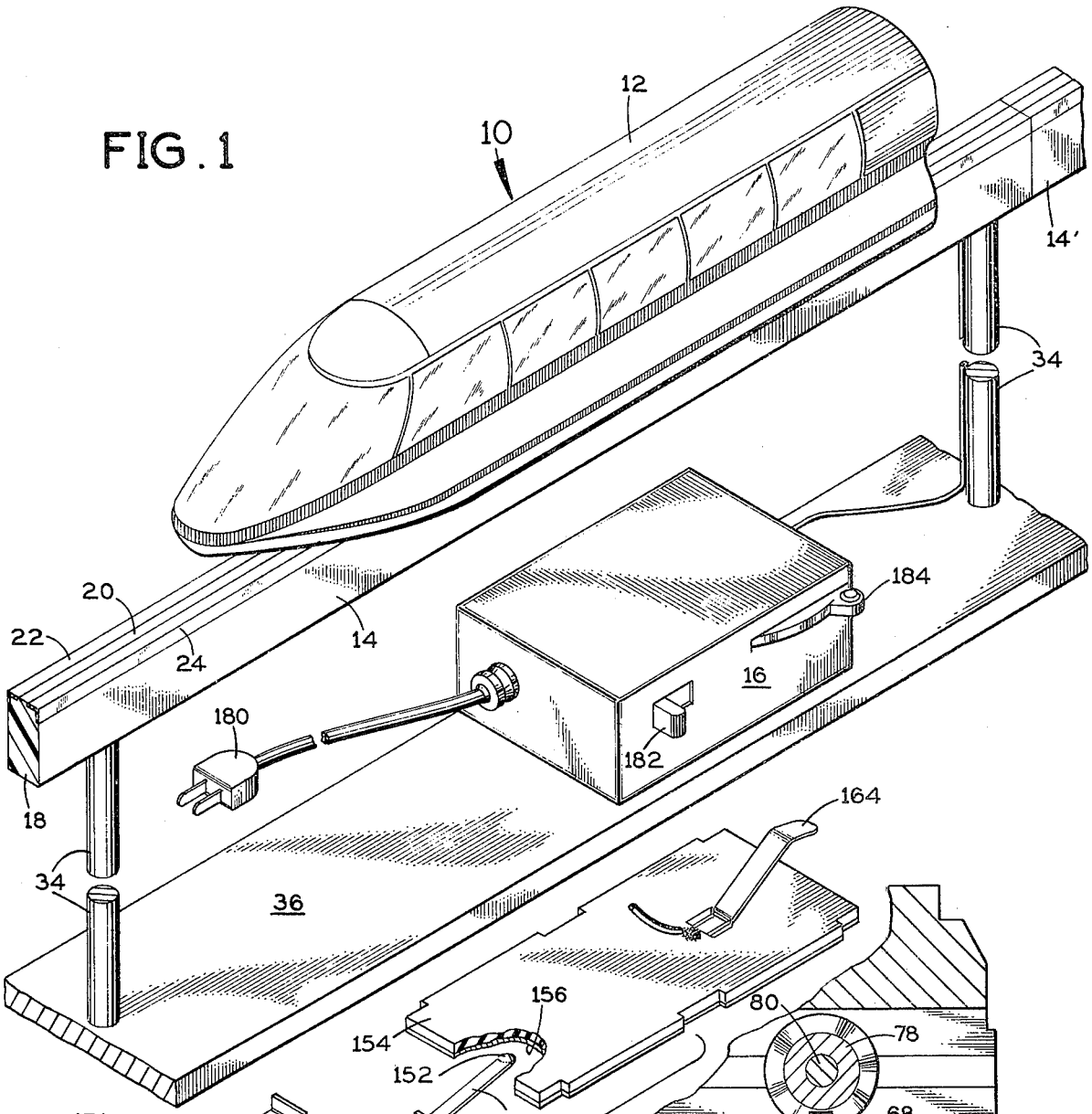
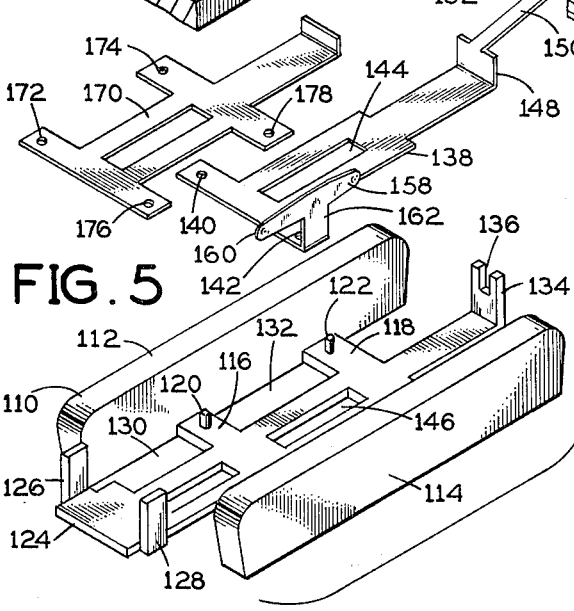
FIG. 5
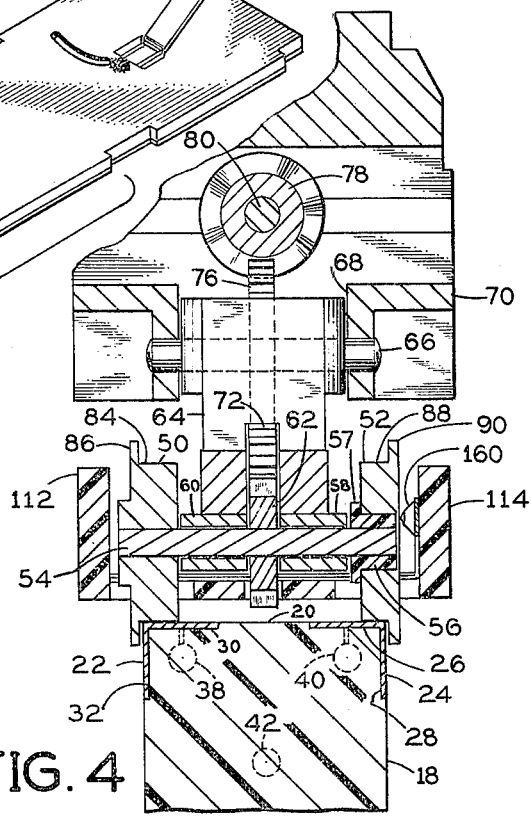
FIG. 4

MONORAIL TRAIN AND TRACK

BACKGROUND OF THE INVENTION

Existing monorail trains often have one set of wheels which ride on top of a monorail, and another set of wheels which ride on the sides of the monorail. Such a wheel and track arrangement is proposed for a toy monorail system in U.S. Pat. No. 3,570,177. In this system electrical contact with the track is provided by fingers which slide along the track. The present invention involves wheels with outside flanges which pick up the current from the track and also support the train laterally, thus eliminating separate side wheels and also eliminating track-contacting fingers. Other train wheels with outside flanges have been proposed, for example, in U.S. Pat. Nos. 3,457,876 and 1,838,652. The present invention involves not only wheels with outside flanges, but also L-shaped conductor tracks for engaging both the rims and the flanges of the wheels, thus providing excellent electrical contact between the wheels and the L-shaped conductors, as well as maintaining the engine on the track and making it easier to place the engine on the track.

SUMMARY OF THE INVENTION

In a monorail train in accordance with the invention, there is a motor, drive train, electrically conductive wheels coupled to the motor by the drive train, and electrical connections from certain wheels to the motor. The improvement of the invention comprises a monorail track including an insulating body having an insulating upper surface and two electrical conductor means forming two L-shaped corners for the upper surface for conducting current. Each of the conductor means has a vertical leg and a horizontal leg. Wheels for the engine are arranged in pairs for straddling the track. One wheel in each pair is engageable with both legs of one of the conductor means, and the other wheel in each pair is engageable with both legs of the other conductor means. The electrical connections include contact means slidably engageable with one wheel in each pair.

Accordingly, it is an object of the invention to provide an improved arrangement of the wheels and tracks for a monorail train.

Another object of the invention is to provide tracks for a monorail in the form of L-shaped conductors.

Another object of the invention is to provide wheels for a monorail train, particularly a model monorail train, with the wheels having both rims and outside flanges for respectively contacting horizontal legs and vertical legs of L-shaped conductors on a monorail.

Another object of the invention is to provide in the arrangement just described contacts slidably engaging the wheels for supplying current through electrical connections to a motor of the train.

A further object of the invention is to electrically insulate the wheels of the train from each other.

A further object of the invention is to properly space the wheels of the train from each other and from gears included in the drive mechanism of the train.

Further objects and advantages of this invention will be apparent from the following detailed description of a presently-preferred embodiment, shown in the accompanying drawings.

BRIEF DESCRIPTION OF THE DRAWINGS

FIG. 1 is a perspective view of a model monorail train in accordance with a preferred embodiment of the invention;

FIG. 4 is a sectional view taken along line 4—4 of FIG. 2 and looking in the direction of the arrows;

FIG. 5 is a perspective view showing certain parts of the engine in exploded relation.

Figures 2, 3, 6:
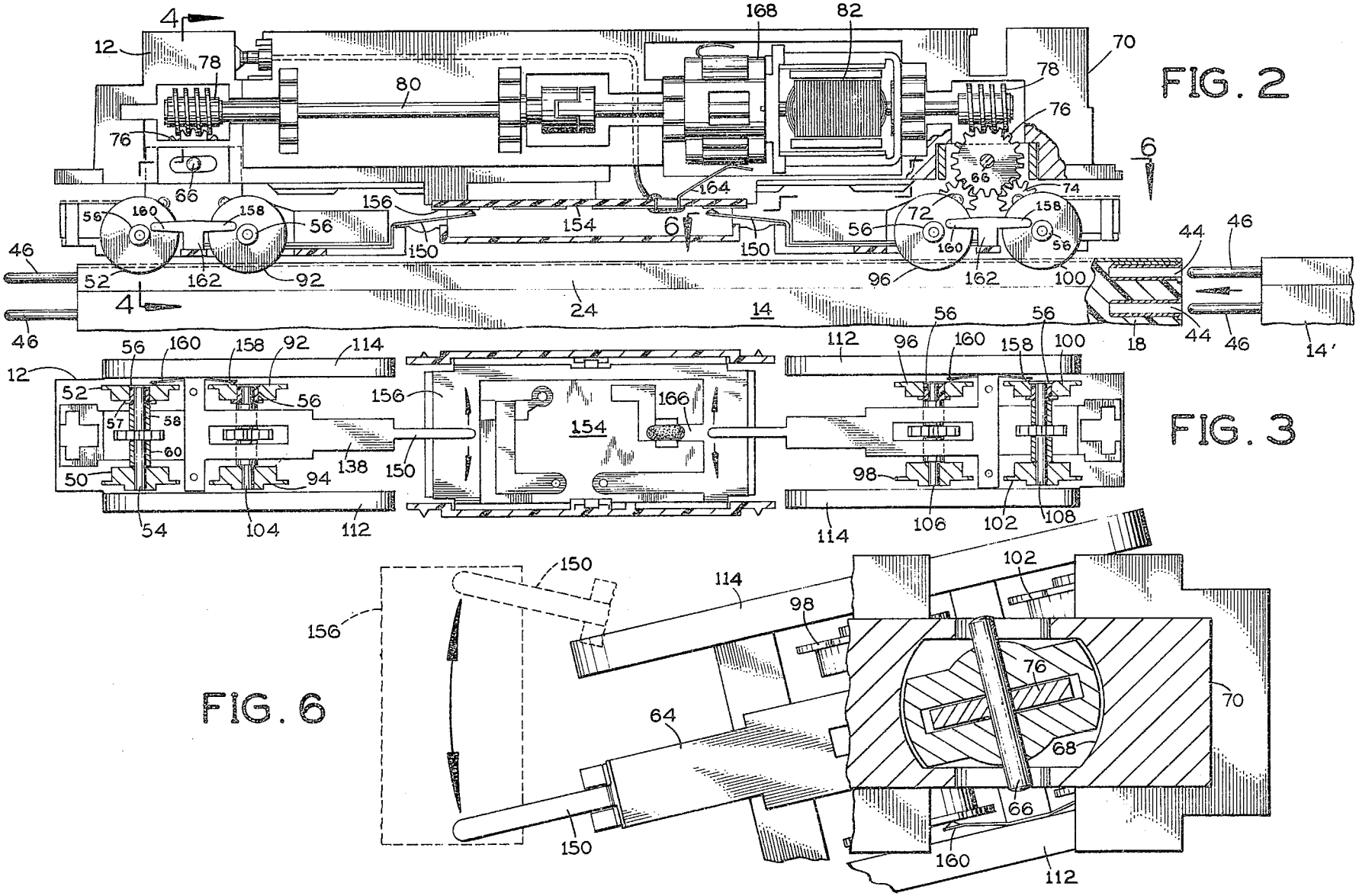
FIG. 2 is a side elevational view of the train engine of FIG. 1 with the outer shell removed and with certain parts shown in section.
FIG. 3 is a bottom sectional view of the engine of FIG. 2.
FIG. 6 is a sectional view taken along line 6—6 of FIG. 2 and looking in the direction of the arrows.

Before explaining the disclosed embodiment of the present invention in detail, it is to be understood that the invention is not limited in its application to the details of the particular arrangement shown since the invention is capable of other embodiments. Also, the terminology used herein is for the purpose of description and not limitation.

The model monorail train 10 includes an engine 12, a monorail track 14 and a transformer 16. The train normally includes other cars (not shown). The track 14 includes an insulating body 18 having an insulating upper surface 20, and two L-shaped conductors 22 and 24 forming outside corners for the upper surface 20. The conductor 24 has a horizontal leg 26 and a depending vertical leg 28. The conductor 22 has a horizontal leg 30 and a depending vertical leg 32. The insulating body 18 is supported on vertical posts 34 which extend up from a base 36. j The monorail 14 is constructed in sections which are joined together in the manner shown particularly in FIGS. 2 and 4. The insulating body 18 has three recesses 38, 40 and 42 (FIG. 4). Mounted in these recesses there are conductive sleeves 44, (FIG. 2) and the upper two sleeves are electrically connected respectively to the L-shaped conductors 22 and 24. The next adjoining monorail section 18' has three pins 46 which fit into the sleeves 44. The upper two pins 46 are electrically connected respectively to the two L-shaped conductors on the top of monorail section 14'. It may be seen that each monorail section has pins 46 at one end and sleeves 44 at the other end, thus making it possible to join monorail sections together so as to provide continuous track.

Referring to FIG. 4 two wheels 50 and 52 of the engine 12 are visible. The wheels 50 and 52 are electrically conductive. The wheels 50 and 52 are connected together by an axle 54 on which they turn. In this embodiment the axle is electrically conductive. The wheel 52 is electrically insulated from the axle 54 by the insulating bushing 56 on the right end of axle 54 at the center of wheel 52. Bushing 56 has flange 57 for engaging a spacer 58.

There are conductive spacers 58 and 60 between the wheels 50 and 52 to properly space the wheels from each other and from a central gear 62 which is mounted on the axle 54 to turn with the axle. The spacers 58 and 60 and the gear 62 are located within a block 64 which is mounted pivotally by a pin 66 within a recess 68 of a casting 70 (see FIGS. 4 and 6). The gear 62 forms part of a drive train which also includes gears 72 and 74, gear 76, and worm gear 78.

Referring to FIG. 2 it may be seen that there are two worm gears 78 mounted on a shaft 80 which is connected to an electrical motor 82. The electrical motor 82 supplies the power which is transmitted to the wheels by the drive train.

Referring again to FIG. 4, it may be seen that the wheel 50 includes rim 84 and a vertical flange 86. The rim 84 rides on the horizontal leg 30 of conductor 22, and the flange 86 is engageable with the vertical leg 32 of conductor 22. Similarly, wheel 52 has a rim 88 and a vertical flange 90. The rim 88 rides on the horizontal leg 26 of conductor 24, and the flange 90 is engageable with the vertical leg 28 of conductor 24 to supply electrical power through the conductors to the wheels 50 and 52. Since the wheels touch both the horizontal legs and the vertical legs of the conductors, good electrical contact between the wheels and the conductors is assured. The wheels are also drive wheels, and they support the engine both laterally and vertically.

The wheels 50 and 52 are visible is FIG. 3 at the left end of the engine. These wheels are grouped together with two like wheels 92 and 94. At the right end of the engine there are four additional wheels 96, 98, 100 and 102. Wheels 52, 92, 96 and 100 are all insulated from the axles 54, 104, 106 and 108 in the manner described previously. Current for running the motor 82 is supplied to the motor through the wheels 52, 92, 96 and 100. The other wheels 50, 94, 98 and 102 provide a ground return.

FIG. 5 shows the structure for mounting the wheels 50, 52, 92 and 94 and also the structure for picking up current from wheels 52 and 92. These wheels are received in a insulating frame 110 which includes two side members 112 and 114. The side members are connected together by crosspieces 116 and 118 which carry protrusions 120 and 122 for alignment purposes. An elongated member 124 extends through the crosspieces 116 and 118 and has two upstanding clips 126 and 128 at its left end. The frame 110 receives the block 64, and the clips 126 and 128 snap into small recesses (not shown) in the block for holding the frame and the block together. The wheels extend through openings such as 130 and 132. At the right end of member 124 there is another clip 134 which includes a vertical slot 136.

The conductive member 138 fits into the frame 110 such that the pin 120 extends through the opening 140. A corresponding pin (not shown) extends through another opening 142. The opening 144 lines up with opening 146, and these openings receive the gear 62. The flange 148 rests against clip 134, and the tongue 150 projects through vertical slot 136. The tongue 150 carries a sliding contactor 152 which engages the underside of a printed circuit board 154 and provides sliding contacts with a conductive area 156 on the board as shown in FIG. 3. Contact fingers 158 and 160 extend laterally from a post 162. These contact fingers are visible in FIG. 3, and it may be seen there that the contact fingers slidably engage the wheels 52 and 92. The contact fingers 158 and 160 serve as sliding contact means for picking up current from the wheels 52 and 92, the current being conducted through member 138 to the conductive area 156 on the printed circuit board 154.

On the upperside of board 154 there is finger 164 which is connected to an extension of the conductive area 156 by soldering through the board. Actually, the extension 166 of the conductive area 156 projects up through the board 154, and the finger 164 is soldered to the projection.

As shown in FIG. 2 the finger 164 slidably engages the rotor 168 of the motor 82. Thus, current is supplied from the transformer 16 through the conductor 24, wheels 52 and 92, fingers 158 and 160, member 138, conductive area 156 and finger 164 to the motor 82. As previously mentioned, conductor 22 provides a ground return to the transformer 16.

Returning to FIG. 5, an insulator 170 fits on top of member 138 such that the pins 120 and 122 extend through openings 172 and 174 for alignment purposes.

The wheel and track arrangement for wheels 96, 98, 100 and 102 is exactly the same as that described above for wheels 52, 50, 92 and 94.

The transformer 16 has a plug 180 for a wall receptacle and a switch 182 for change of direction. Sliding lever 184 provides on/off and speed control.

Having thus described my invention, I claim:

1. In a model monorail train including an engine having an electric motor, conductive wheels, a drive train coupled between said motor and said wheels for driving said wheels, electrical connection means connected between said motor and said wheels for supplying current to said motor, and a track for conducting current, the improvement wherein:

said wheels have rims with vertical flanges on one side thereof and are arranged in pairs to straddle said track;

said flanges are positioned on the outsides of said track when said engine is on said track;

said track comprises monorail means for receiving said wheels;

said monorail means has an insulating upper surface and two L-shaped conductor means forming outside corners of said upper surface for engaging both said rims and said flanges of said wheels; and said L-shaped conductor means each have a horizontal leg for engaging the rims of corresponding wheels and a vertical leg for engaging the flanges of corresponding wheels.

2. The model monorail train as claimed in claim 1 including further:

means for electrically insulating said wheels of each said pair from each other;

said electrical connection means including contact means slidably engaging one wheel of each said pair;

and means for supplying electrical current to said conductor means for flow through said one wheel of each pair and said electrical connection means to said motor.

3. The model monorail train as claimed in claim 2 wherein:

the wheels in each of said pairs have an axle connecting them together;

and each said insulating means comprises an insulating bushing on said axle at the center of said one wheel.

4. The model monorail train as claimed in claim 3 wherein:

each said contact means conprises a conductive finger slidably engaging said one wheel.

5. In a monorail train including an engine having a motor, a drive train, electrically conductive wheels coupled to the motor by the drive train, and electrical connections from certain wheels to the motor, the improvement comprising:

a monorail track including an insulating body having an upper surface and two electrical conductor means forming two L-shaped corners for said upper surface for conducting current, with each of said conductor means having a vertical leg and a horizontal leg;

and wherein said wheels are arranged in pairs having outside flange means for straddling said track, with one wheel in each pair engageable with both legs of one of said conductor means and the other wheel in each pair engageable with both legs of the other said conductor means;

and said electrical connections including contact meand slidably engageable, with said one wheel of each said pair.

6. The train as claimed in claim 5 in which:

each of said pairs of wheels has an axle connecting them together, and means electrically insulating said one wheel from said other wheel.

7. The train as claimed in claim 6 in which:

said insulating means comprises an insulating bushing on said axls at the center of said one wheel.

8. The train as claimed in claim 7 in which:

said contact means comprises a conductive finger engaging said one wheel.

9. The train as claimed in claim 8 in which:

said axle has spacer means thereon between said wheels for spacing purposes.

10. The train as claimed in claim 9 in which:

said bushing includes a vertical flange at the inside of said one wheel for engaging said spacer means.

* * * * *